US009818296B2

(12) United States Patent
Knoepfle et al.

(10) Patent No.: US 9,818,296 B2
(45) Date of Patent: Nov. 14, 2017

(54) SYSTEM FOR PROVIDING A CITY PLANNING TOOL

(71) Applicant: Uber Technologies, Inc., San Francisco, CA (US)

(72) Inventors: Daniel Knoepfle, San Francisco, CA (US); Jonathan Hall, San Francisco, CA (US)

(73) Assignee: Uber Technologies, Inc., San Francisco, CA (US)

( * ) Notice: Subject to any disclaimer, the term of this patent is extended or adjusted under 35 U.S.C. 154(b) by 26 days.

(21) Appl. No.: 14/885,578

(22) Filed: Oct. 16, 2015

(65) Prior Publication Data

US 2017/0110009 A1 Apr. 20, 2017

(51) Int. Cl.
*G08G 1/01* (2006.01)

(52) U.S. Cl.
CPC ..... *G08G 1/0129* (2013.01); *G08G 1/0112* (2013.01)

(58) Field of Classification Search
CPC ..... G08G 1/0129; G08G 1/0112
See application file for complete search history.

(56) References Cited

U.S. PATENT DOCUMENTS 8,918,278 B2 * 12/2014 Feldman ..... G08G 1/0104 701/118
9,368,027 B2 * 6/2016 Jang ..... G08G 1/0112
2006/0111833 A1 * 5/2006 Feldman ..... G08G 1/0104 701/117
2008/0123545 A1 * 5/2008 Watanabe ..... H04L 43/026 370/252
2009/0002195 A1 * 1/2009 Horvitz ..... G08G 1/0104 340/934
2009/0210142 A1 * 8/2009 Couckuyt ..... G01C 21/3461 701/532
2010/0211301 A1 * 8/2010 McClellan ..... G08G 1/0104 701/119
2010/0328100 A1 * 12/2010 Fujiwara ..... G08G 1/0104 340/905
2011/0106416 A1 5/2011 Scofield
2011/0153183 A1 6/2011 Cohn
2012/0083995 A1 4/2012 Vorona
(Continued)

FOREIGN PATENT DOCUMENTS

JP 2009-259158 11/2009

OTHER PUBLICATIONS

ISR and Written Opinion issued in PCT/US2016/057151 dated Dec. 20, 2016.

*Primary Examiner* — Anne M Antonucci
(74) *Attorney, Agent, or Firm* — Mahamedi IP Law LLP

(57) ABSTRACT

A system and method for generating traffic reports is described. The system receives a set of inputs specifying at least a geographical region, a first period of time, and a second period of time. The system then identifies one or more streets within at least a threshold proximity of the specified geographical region and aggregates traffic information for the one or more streets over the first period of time and the second period of time, respectively. Further, the system generates a traffic report for the geographical region based at least in part on a comparison of the aggregated traffic information for the first period of time with the aggregated traffic information for the second period of time.

20 Claims, 11 Drawing Sheets

(56) References Cited

U.S. PATENT DOCUMENTS

| | | | | |
|---|---|---|---|---|
| 2015/0095830 | A1 | 4/2015 | Massoumi et al. | |
| 2015/0127245 | A1* | 5/2015 | Jang | G08G 1/0112 701/117 |

* cited by examiner

SYSTEM FOR PROVIDING A CITY PLANNING TOOL

BACKGROUND

An on-demand service system can arrange for an on-demand service to be provided for a requesting user by a service provider. In some examples, the service provider's automobile may be equipped with various on-board sensors. These sensors may draw power from the service provider's automobile and may communicate wirelessly with a mobile handset to relay sensor data to a server associated with the on-demand service system. The on-demand service system may use the sensor data to monitor the status, and/or location, of its service providers.

DETAILED DESCRIPTION

Figure 1:
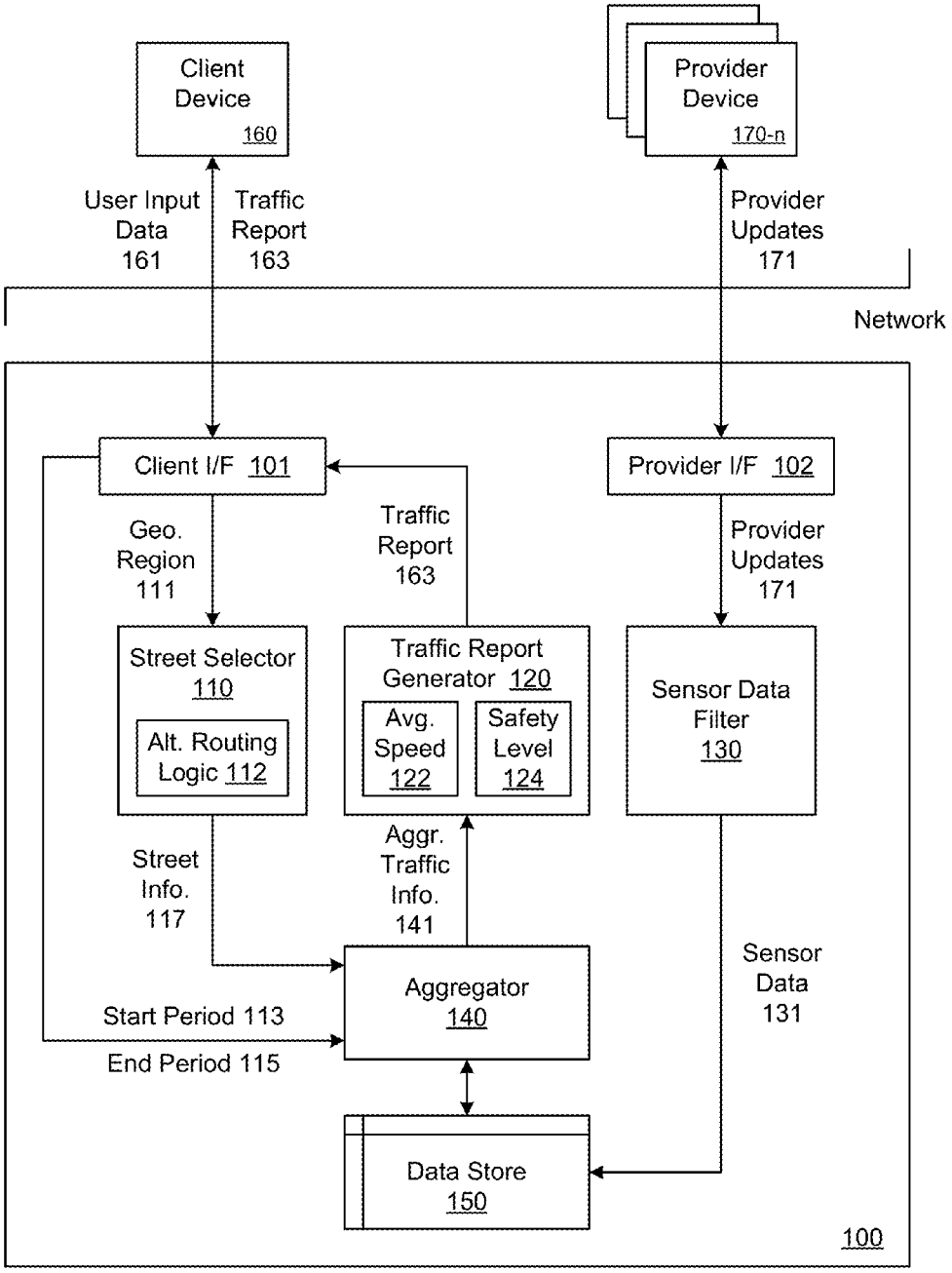
FIG. 1 illustrates an example system for generating traffic reports in connection with an on-demand service.

Examples described herein provide for a system that can generate traffic reports based on sensor data collected from vehicles used in an on-demand service environment. The system may be used as a city planning tool, for example, by allowing city planners to view the effects of road and/or construction projects and/or other changes on selected streets and neighborhoods. More specifically, the traffic reports may allow city planners to determine whether a particular construction project achieved its intended effect, and may also be used to predict the effects (e.g., on city traffic) of future construction projects.

In some aspects, the system may receive a set of inputs specifying at least a geographical region, a first period of time, and a second period of time. For example, the geographical region may correspond to an area in which a construction project took place. The first period of time may correspond to a sample duration before the construction began, and the second period of time may correspond to a sample duration after the construction was completed. The system may identify one or more streets within at least a threshold proximity of the specified geographical region and aggregate traffic information for the one or more streets over the first period of time and the second period of time, respectively. For example, the traffic information may include sensor data received from one or more vehicles associated with a transport service. The system may then generate a traffic report for the geographical region based at least in part on a comparison of the aggregated traffic information for the first period of time with the aggregated traffic information for the second period of time.

According to some examples, the traffic information may include an average speed of the one or more vehicles (e.g., of the transport service) while driving on the one or more streets. In some aspects, the traffic report may include a graphical display comparing the average speed on each of the one or more streets during the first period of time with the average speed on each of the one or more streets during the second period of time. In other aspects, the traffic report may include a map display of the geographical region highlighting, for each of the one or more streets, a degree of change in the average speed form the first period of time to the second period of time. Still further, the map display may indicate, for each of the one or more streets, whether the average speed increased or decreased from the first period of time to the second period of time.

Further, according to some examples, the traffic information may include acceleration information for the one or more vehicles while driving on the one or more streets. In some aspects, the system may determine a safety level for each of the one or more streets based at least in part on the acceleration information. For example, "hard braking" statistics (e.g., deceleration >7 mph/s) may be used to estimate an occurrence and/or probability of accidents on the one or more streets. Thus, a greater occurrence of hard-braking may correlate with a lower safety level. The traffic report may indicate, for each of the one or more streets, whether the safety level increased or decreased form the first period of time to the second period of time.

In some aspects, the one or more streets may include streets that are located within the specified geographical region and/or streets neighboring streets that may otherwise be affected by changes in the traffic patterns of the streets located within the specified geographical region. For example, the system may identify a first subset of streets that are located within the geographical region. The system may further determine a set of alternate routes for the first subset of streets. The set of alternate routes may include streets that intersect or run parallel to streets in the first subset (e.g., and may thus be used to route traffic around the area directly affected by construction and/or other changes). The system may then identify a second subset of streets that belong to the set of alternate routes.

Among other benefits and advantages, examples as described may provide valuable insight into the actual effects on city traffic caused by a particular road construction project. For example, by leveraging vehicle sensor data from actual vehicles used by an on-demand transport service, the traffic reports may highlight any changes in the traffic patterns (e.g., average speeds, probability of accidents, etc.) of streets that are directly and/or indirectly affected by construction projects in a particular geographical region.

As used herein, a "driver," a "provider," a "service provider," a "supplier," or a "vendor," are invariably used to refer to individuals or entities that can provide an on-demand service. Also, as used herein, a "client device," a "user device," and/or a "computing device" refer to devices corresponding to desktop computers, cellular devices or smartphones, personal digital assistants (PDAs), laptop computers, tablet devices, television (IP Television), etc., that can provide network connectivity and processing resources for communicating with a transport arrangement system and/or traffic report generating system over a network. A driver device can also correspond to other devices of a transit object, such as an in-vehicle computing system, or custom hardware, etc. The driver device can also operate a designated service application that is configured to communicate with the on-demand service system and/or the transport personalization system. Still further, while some examples described herein relate to transport services, the systems described herein can be used to provide other on-demand services, such as a food truck service, a delivery service, an entertainment service, etc.

One or more examples described herein provide that methods, techniques, and actions performed by a computing device are performed programmatically, or as a computer-implemented method. Programmatically, as used herein, means through the use of code or computer-executable instructions. These instructions can be stored in one or more memory resources of the computing device. A programmatically performed step may or may not be automatic.

One or more examples described herein can be implemented using programmatic modules, engines, or components. A programmatic module, engine, or component can include a program, a sub-routine, a portion of a program, or a software component or a hardware component capable of performing one or more stated tasks or functions. As used herein, a module or component can exist on a hardware component independently of other modules or components. Alternatively, a module or component can be a shared element or process of other modules, programs or machines.

Some examples described herein can generally require the use of computing devices, including processing and memory resources. Examples described herein may be implemented, in whole or in part, on computing devices such as servers, desktop computers, cellular or smartphones, personal digital assistants (e.g., PDAs), laptop computers, printers, network equipment (e.g., routers) and tablet devices. Memory, processing, and network resources may all be used in connection with the establishment, use, or performance of any example described herein (including with the performance of any method or with the implementation of any system).

Furthermore, one or more examples described herein may be implemented through the use of instructions that are executable by one or more processors. These instructions may be carried on a computer-readable medium. Machines shown or described with figures below provide examples of processing resources and computer-readable mediums on which instructions for implementing examples can be carried and/or executed. In particular, the numerous machines shown with examples include processor(s) and various forms of memory for holding data and instructions. Examples of computer-readable mediums include permanent memory storage devices, such as hard drives on personal computers or servers. Other examples of computer storage mediums include portable storage units, such as CD or DVD units, flash memory (such as carried on smartphones, multifunctional devices or tablets), and magnetic memory. Computers, terminals, network enabled devices (e.g., mobile devices, such as cell phones) are all examples of machines and devices that utilize processors, memory, and instructions stored on computer-readable mediums. Additionally, examples may be implemented in the form of computer-programs, or a computer usable carrier medium capable of carrying such a program.

System Description

FIG. 1 illustrates an example system 100 for generating traffic reports in connection with an on-demand service. Depending on implementation, one or more components of the system 100 can be implemented on a computing device, such as a server, laptop, PC, etc., or on multiple computing devices that can communicate with a client device 160 and one or more provider devices 170 over one or more networks. In some examples, a computing device can operate or execute an application to perform one or more of the processes described by the various components of the system 100. The system 100 can also be implemented through other computer systems in alternative architectures (e.g., peer-to-peer networks, etc.).

As described herein, the system 100 can be a part of or communicate with an on-demand service system, such as a transport arrangement system of the on-demand service system. Examples of an on-demand service can include a transport service, a food truck service, a delivery service, a traveling entertainment service, etc. A transport arrangement system for a transport service, for example, can receive requests from users operating requesting devices and arrange for transport services to be provided to the users by service providers (e.g., drivers).

In example implementations, the system 100 includes a client interface 101, provider interface 102, street selector 110, traffic report generator 120, sensor data filter 130, aggregator 140, and data store 150. The system 100 may generate and provide customized traffic reports 163 to the client device 160 based at least in part on provider data 171 received from one or more provider devices 170. Depending on implementation, one or more components of the system 100 can be implemented on network-side resources, such as one or more servers. As an addition or an alternative, some or all of the components of the system 100 can be implemented on client devices, such as through applications that operate on the client device 160. For example, a client application can execute to perform one or more of the processes described by the various components of the system 100.

The system 100 can communicate, over one or more networks (e.g., wirelessly or via a wired connection), with the provider devices 170 using the provider interface 102. In some examples, the provider devices 170 can individually operate an application that can interface with the provider interface 102 to communicate with the system 100. According to some examples, the applications can include or use an application programming interface (API), such as an externally facing API, to communicate data with the provider interface 102. The externally facing API can provide access to the system 100 via secure access channels over the network through any number of methods, such as web-based forms, programmatic access via restful APIs, Simple Object Access Protocol (SOAP), remote procedure call (RPC), scripting access, etc., while also providing secure access methods including key-based access to ensure the system 100 remains secure and only authorized users, service providers, and/or third parties can gain access to the system 100.

The system 100 can receive provider updates 171, via the provider interface 102, from a plurality of provider device 170. The provider updates 171 can provide current information about the respective devices and/or their respective users. For example, for each provider device 170, the provider update 171 can include identification information of the service provider or the provider device, the type of vehicle the service provider drives, the service that the service provider provides, the service provider's availability status (e.g., indicating that the service provider is available for service, is off-duty, or is currently servicing other users), and/or sensor data indicating the current state of the provider device 170. For example, each provider device 170 may include, or may otherwise be coupled to, one or more sensors (e.g., global positioning satellite (GPS), inertial measurement unit (IMU), accelerometers, altimeters, photosensors, etc.) to detect the current state and/or status of the service provider's vehicle.

In some examples, provider updates 171 can be received when a service provider launches or starts a service application on a respective provider device 170. In other examples, provider updates 171 can be received when the service provider performs certain actions using the service application (e.g., the service provider notifies that he or she is available for providing services or has just completed one or more activities related to the on-demand service). The provider interface 102 can also receive provider updates 171 periodically, at different instances in time, or based on a set schedule, after the service provider launches or starts the service application. Still further, a provider device 170 can transmit provider updates 171 during a duration of time when the provider is traveling in the course of performing a transport service (e.g., while traveling to a pickup location and/or a destination location of a requesting user). By periodically receiving provider updates 171, for example, the system 100 may determine real-time traffic information for at least the streets and/or routes traveled by the service providers.

The sensor data filter 130 may receive the provider updates 171 form the provider interface 102, and parse the provider updates 171 for sensor data 131. As described above, the provider updates 171 may include sensor data from a GPS module, an IMU sensor, and/or one or more accelerometers. The GPS sensor data may include location and/or position information that may be used to detect the whereabouts of the service provider's vehicle. The IMU sensor data may include velocity, orientation, and/or gravitational information that may be used to detect the vehicle's bearing and/or calculate an estimated arrival time. Furthermore, accelerometer data may indicate a rate of acceleration or deceleration of the corresponding vehicle at any given time.

The sensor data filter 130 may acquire and store the sensor data 131 in the data store 150. In some aspects, each set of sensor data 131 may be stored with a corresponding timestamp indicating a time and/or date which the sensor data 131 was generated (e.g., by one or more sensors of the provider device 170) or received by the system 100. For example, in some implementations, the provider updates 171 may be transmitted with a timestamp based on the time of transmission. In other implementations, the sensor data filter 130 (or the provider interface 102) may add a timestamp to the sensor data 131, upon receiving the provider updates 171, based on the time of reception.

The system 100 can also communicate, over one or more networks, with a client device 160 via the client interface 101. The client device 160 may be used to request and/or display traffic reports 163 for particular geographical region and/or time periods. For example, the traffic reports 163 may indicate how a particular construction project may have affected traffic on streets running through and/or around the construction zone. Thus, the traffic reports 163 may be used (e.g., by a city planner or city planning service) to assess the effects of past construction projects and/or to predict the impact of future construction projects. While the client device 160 is illustrated in the example of FIG. 1 as communicating with the system 100 over the one or more networks, in some examples, the client device 160 can be included with or be a part of the system 100.

In some examples, the client device 160 can operate an application that can interface with the client interface 101 to communicate with the system 100. According to some examples, the applications can include or use an API, such as an externally facing API, to communicate data with the client interface 101. The externally facing API can provide access to the system 100 via secure access channels over the network through any number of methods, such as web-based forms, programmatic access via restful APIs, SOAP, RPC, scripting access, etc., while also providing secure access methods including key-based access to ensure the system 100 remains secure and only authorized users, service providers, and/or third parties can gain access to the system 100.

The system 100 can receive user input data 161, via the client interface 101, from the client device 160. The user input data 161 may include a set of user-defined parameters that may be used for generating a particular traffic report 163. For example, in some aspects, the user input data 161 may specify at least a geographical region, a first period of time (e.g., a start period), and a second period of time (e.g., an end period). In some instances, the geographical region may correspond to an area or location (e.g., region on a map) that was directly or indirectly affected by a construction project. For example, the geographical region may include a section of a street that underwent construction and/or repairs. The first period of time may correspond to a time period (e.g., range of times) before the construction began, and the second period of time may correspond to a time period (e.g., range of times) after the construction was completed.

Upon receiving the user input data 161 from the client device 160, the client interface 101 may forward information pertaining to the geographical region 111 to the street selector 111. The geographical region 111 may be identified based on longitude/latitude coordinates, neighborhood names, and/or street names. The street selector 110 may identify one or more streets that may be affected by the construction project based at least in part on the specified geographical region 111. For example, the street selector 110 may identify a first set of streets that are at least partially located within, or bounded by, the geographical region 111. The first set of streets may be directly affected by the construction project within the geographical region 111.

In some aspects, the street selector 110 may further identify a second set of streets that are outside of the geographical region 111, but may still be affected by the construction project. For example, the street selector 110 may include an alternative routing logic 112 to determine one or more alternative routes for the first set of streets. The alternative routes may include a second set of streets that run parallel and/or perpendicular to the first set of streets, and may thus be used (e.g., as a detour) to divert traffic around the geographical region 111. Accordingly, the second set of streets may be indirectly affected by the construction project within the geographical region 111.

The street selector 110 sends street information 117, identifying the first and/or second set of streets associated with the geographical region 111, to the aggregator 140. The aggregator 140 may further receive, from the client interface 101, information pertaining to the start period 113 and end period 115 provided with the user input data 161. In some implementations, the time periods 113 and 115 may be arbitrarily defined by the user of the client device 160. For example, the start period 113 may include a range of time spanning hours, days, weeks and/or months. The end period 115 may similarly include a range of time spanning hours, days, weeks and/or months. Moreover, the length or duration of the start period 113 may vary from the length or duration of the end period 115.

In example aspects, the aggregator 140 may generate and/or aggregate traffic information 141 based on sensor data acquired from vehicles driving on the selected streets during the specified time periods. For example, the aggregator 140 may search the data store 150 for sensor data (e.g., GPS data, IMU data, and/or accelerometer data) acquired from vehicles driving on the selected streets identified by the received street information 117. In some implementations, the selected streets may be searched based on GPS data stored in the data store 150.

Furthermore, the aggregator 140 may filter the search results based on the first period of time and the second period of time. For example, the aggregator 140 may retrieve only the sensor data that was transmitted or received (e.g., from vehicles driving on the selected streets) during either the start period 113 or the end period 115. In some implementations, the aggregator 140 may filter the search results based on the timestamp associated with the sensor data stored in the data store 150.

In some implementations, the traffic information 141 may account for only a subset of the sensor data stored in the data store 150. For example, as described above, the provider updates 171 may include a number of sensor data 131 that may not be relevant for detecting traffic patterns on one or more streets (e.g., altimeter data, photosensor data, etc.). Accordingly, the aggregator 140 may retrieve and/or aggregate only the relevant sensor data (e.g., GPS data, IMU data, and/or accelerometer data) for the selected streets and time periods.

The traffic report generator 120 receives the aggregated traffic information 141 from the aggregator 140 and generates the traffic report 163 based on the aggregated traffic information 141. The traffic report 163 may highlight or otherwise indicate the effects on traffic, in the geographical region 111, caused by or otherwise attributable to the construction project. For example, the traffic report 163 may include graphical and/or map displays comparing the aggregated traffic information 141 from the start period 113 with the aggregated traffic information 141 from the end period 115

In some aspects, the traffic report generator 120 may include an average speed calculator 122 to determine the average speeds of vehicles on the selected streets identified by the street information 117. For example, the speed and/or velocity of a particular vehicle may be included with the IMU sensor data transmitted by that vehicle (e.g., to the system 100) while driving on one or more of the selected streets. Alternatively, or in addition, the speed and/or velocity of a particular vehicle may be determined based on GPS data transmitted by that vehicle (e.g. to the system 100) while driving on one or more of the selected streets (e.g., by calculating a rate of change in the position or location of the vehicle, as indicated by the GPS data). The average speed calculator 122 may then average the speeds determined for each selected street with respect to the start period 113 and with respect to the end period 115.

In other aspects, the traffic report generator 120 may include a safety level calculator 124 to determine a safety level (e.g., or probability of accidents) of the selected streets identified by the street information 117. For example, the accelerometer data may be used to determine how quickly vehicles are accelerating or braking on the selected streets. "Hard braking," which may be characterized by a rate of deceleration of at least 7 mph per second, typically occurs when an operator of a vehicle slams the brake pedal in an attempt to avoid an accident or collision with another object on the road. Hard-braking statistics may thus be useful for estimating a probability of accidents on the selected streets. More specifically, greater occurrences of hard-braking may correlate to lower safety values (e.g., and a greater probability of accidents), and vice-versa.

In some examples, the traffic report 163 may include a graphical comparison of the average speeds and/or safety levels of the first set of streets during the start period 113 with the average speeds of the first set of streets during the end period 115. In other examples, the traffic report 163 may include a graphical comparison of the average speeds and/or safety levels of the first and second sets of streets during the start period 113 with the average speeds of the first and second sets of streets during the end period 115. Still further, in some examples, the traffic report 163 may include a map display highlighting a degree of change or variance in the average speeds and/or safety levels of one or more of the selected streets between the start period 113 and the end period 115. Furthermore, the map display may differentiate streets that experienced an overall increase in average speeds and/or safety levels from streets that experienced an overall decrease in average speeds.

The traffic report 163 may be transmitted, via the client interface 101, to the client device 160. The traffic report 163 may then be rendered or otherwise presented to the user through an application running on the client device 160.

Methodology

Figure 2:
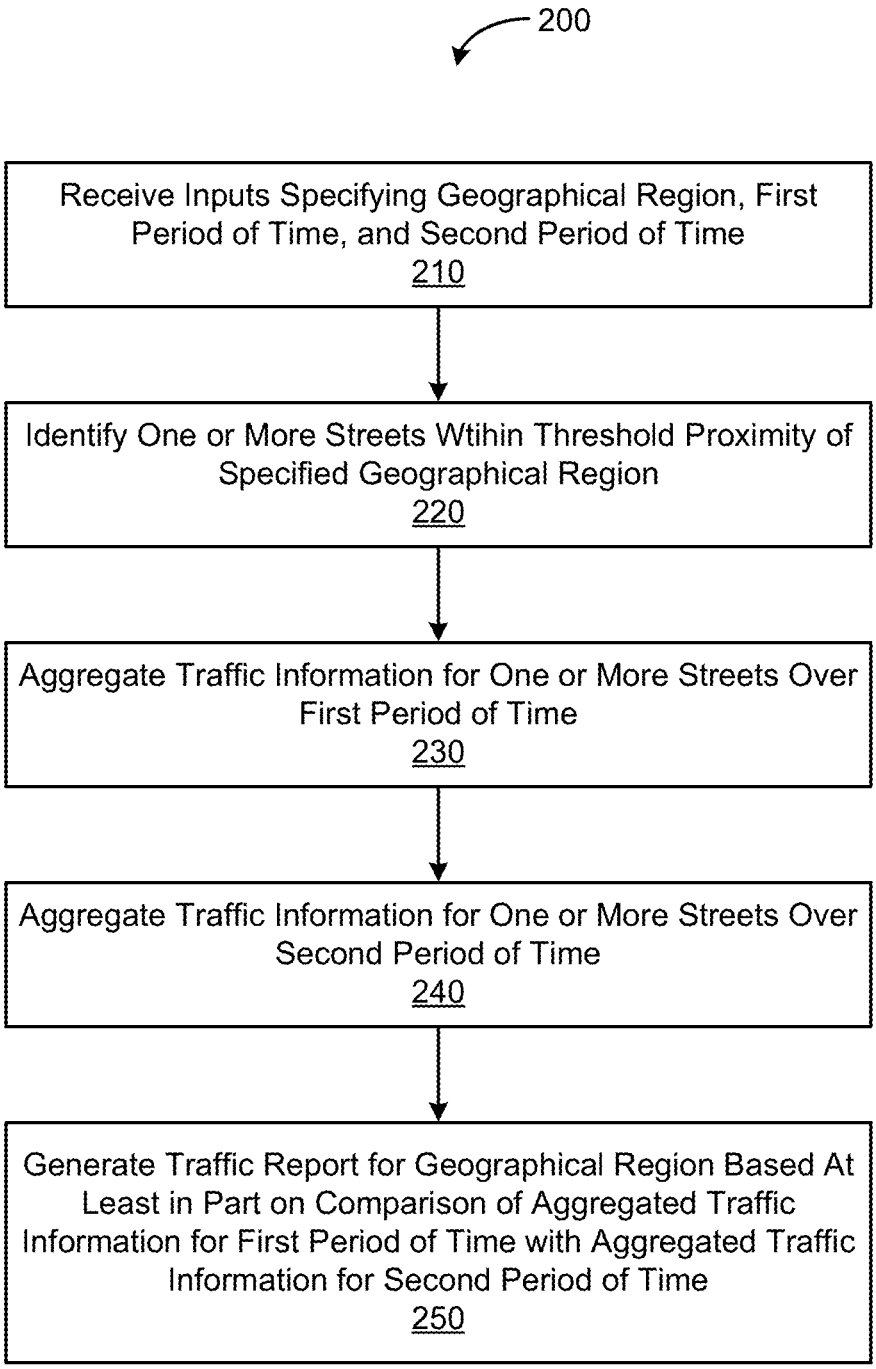
FIG. 2 illustrates an example method of generating traffic reports for a specified geographical region.

FIG. 2 illustrates an example method 200 of generating traffic reports for a specified geographical region. A method such as described by an example of FIG. 1 can be implemented, for example, by the system 100 of FIG. 1. Accordingly, references made to elements of FIG. 1 are for purposes of illustrating a suitable element or component for performing a step or sub-step being described.

The system 100 initially receives a set of inputs specifying at least a geographical region, a first period of time, and a second period of time (210). For example, the geographical region may correspond to an area or location that was directly or indirectly affected by a construction project. The first period of time may correspond to a time period before the construction began, and the second period of time may correspond to a time period after the construction was completed. In some aspects, the system 100 may receive the set of inputs from a client device 160 (e.g., via the client interface 101).

The system 100 identifies one or more streets located within at least a threshold proximity of the specified geographical region (220). For example, the geographical region may be identified based on longitude/latitude coordinates, neighborhood names, and/or street names. In some aspects, the street selector 110 may identify a first set of streets that are at least partially located within, or bounded by, the geographical region 111. In other aspects, the street selector 110 and/or alternative routing logic 112 may further determine one or more alternative routes for the first set of streets. The alternative routes may include a second set of streets that run parallel and/or perpendicular to the first set of streets, and may thus be used (e.g., as detour) to divert traffic around the geographical region 111.

The system 100 then aggregates traffic information for the one or more streets over the first period of time (230). For example, the aggregator 140 may generate and/or aggregate traffic information 141 based on sensor data acquired from vehicles driving on the selected streets during the first time period (e.g., the start period 113). More specifically, the aggregator 140 may retrieve, from the data store 150, only the relevant sensor data (e.g., traffic information) that was transmitted or received (e.g., from vehicles driving on the selected streets) within the range of time corresponding to the start period 113.

The system 100 further aggregates traffic information for the one or more streets over the second period of time (240). For example, the aggregator 140 may generate and/or traffic information 141 based on sensor data acquired from vehicles driving on the selected streets during the second time period (e.g., the end period 115). More specifically, the aggregator 140 may retrieve, from the data store 150, only the relevant sensor data (e.g., traffic information) that was transmitted or received (e.g., from vehicles driving on the selected streets) within the range of time corresponding to the end period 115.

Finally, the system 100 may generate a traffic report for the geographical region based at least in part on a comparison of the aggregated traffic information for the first period of time with the aggregated traffic information for the second period of time (250). The traffic report 163 may highlight or otherwise indicate the effects on traffic, in the geographical region 111, caused by or otherwise attributable to the construction project. For example, the traffic report 163 may include graphical and/or map displays comparing the aggregated traffic information 141 from the start period 113 with the aggregated traffic information 141 from the end period 115

As described above, the traffic report may indicate how a particular construction project may have affected traffic on streets running through and/or around the construction zone. Thus, the traffic report may be used (e.g., by a city planner or city planning service) to assess the effects of past construction projects and/or to predict the impact of future construction projects on the specified geographical region and/or surrounding regions.

Figure 3:
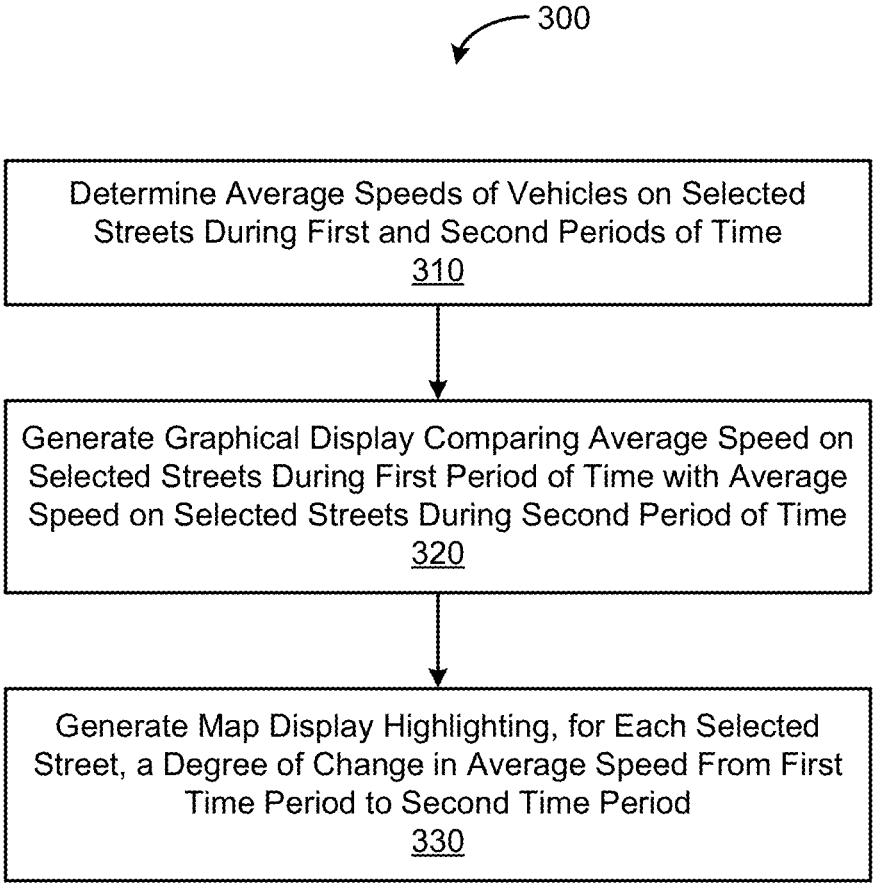
FIG. 3 illustrates an example method of comparing average vehicle speeds on selected streets before and after a construction project.

FIG. 3 illustrates an example method 300 of comparing average vehicle speeds on selected streets before and after a construction project. A method such as described by an example of FIG. 3 can be implemented, for example, by the traffic report generator 120 of FIG. 1. Accordingly, references made to the elements of FIG. 1 are for purposes of illustrate a suitable element or component for performing a step or sub-step being described.

The traffic report generator 120 may determine the average speeds of vehicles on a set of selected streets during a first period of time and a second period of time, respectively (310). For example, the speed and/or velocity of a particular vehicle may be included with the IMU sensor data transmitted by that vehicle (e.g., to the system 100) while driving on one or more of the selected streets. Alternatively, or in addition, the speed and/or velocity of a particular vehicle may be determined based on GPS data transmitted by that vehicle (e.g., to the system 100) while driving on one or more of the selected streets (e.g., by calculating a rate of change in the position or location of the vehicle, as indicated by the GPS data). In some aspects, the traffic report generator 120 and/or average speed calculator 122 may average the speeds determined for each selected street with respect to the first period of time (e.g., the start period 113) and with respect to the second period of time (e.g., the end period 115).

The traffic report generator 120 may the generate a graphical display comparing the average speeds on the selected streets during the first period of time with the average speeds on the selected streets during the second period of time (320). The set of selected streets may include a first subset of streets that are at least partially located within or bounded by a user-specified geographical region, and a second subset of streets that run parallel or perpendicular to one or more streets in the first subset by are located outside of the graphical region. In some examples, the traffic report may include a graphical comparison of the average speeds on only the first subset of streets during the first period with the average speeds of the on the first subset of streets during the second period. In other examples, the traffic report may include a graphical comparison of the average speeds on the first and second subsets of streets during the first period with the average speeds of the first and second subsets of streets during the second period.

The traffic report generator 120 may further generate a map display highlighting, for each selected street, a degree of change or variance in the average speed from the first time period to the second time period (330). For example, the traffic report may include a "heat map" showing the relative changes in average speed experienced by each of the selected streets. Streets that experienced greater changes in average speed may be highlighted differently or otherwise differentiated from streets that experienced lesser changes in average speed. Still further, streets that experienced an overall increase in average speed may be highlighted differently or otherwise differentiated from streets that experienced an overall decrease in average speed. As referred to herein, "highlighting" can correspond to using one or more of colors, patterns, shadings, etc., to distinguish a particular feature from other features (e.g., a street from another street(s), a degree of change from another degree of change, etc.).

Figure 4:
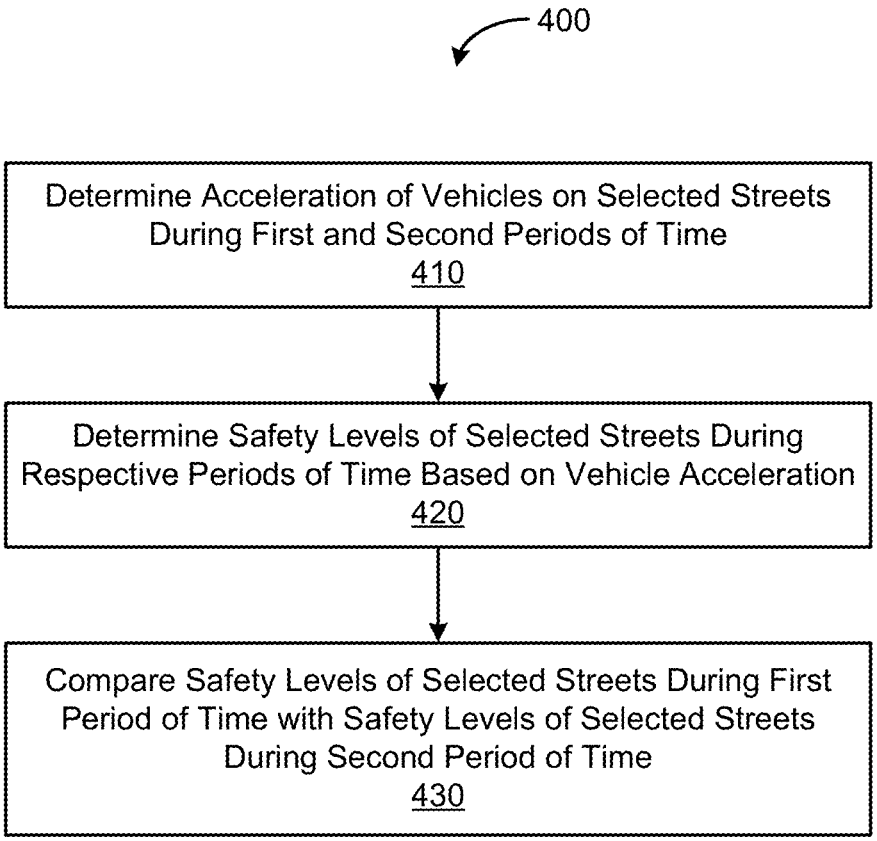
FIG. 4 illustrates an example method of comparing safety levels of selected streets before and after a construction project.

FIG. 4 illustrates an example method 400 of comparing safety levels of selected streets before and after a construction project. A method such as described by an example of FIG. 4 can be implemented, for example, by the traffic report generator 120 of FIG. 1. Accordingly, references made to the elements of FIG. 1 are for purposes of illustrate a suitable element or component for performing a step or sub-step being described.

The traffic report generator 120 may determine acceleration (or deceleration) information for vehicles on a set of selected streets during a first period of time and a second period of time, respectively (410). For example, the acceleration information for a particular vehicle may correspond to accelerometer data transmitted by that vehicle (e.g., to the system 100) while driving on one or more of the selected streets.

The traffic report generator 120 may then determine safety levels of the selected streets during the respective times based on the vehicle acceleration information (420). In some aspects, the traffic report generator 120 and/or safety level calculator 124 may determine how quickly vehicles are accelerating or braking on the selected streets based on the accelerometer data. As described above, hard-braking statistics (e.g., when a vehicle decelerates at a rate of at least 7 mph/s) may be used to estimate a probability of accidents on the selected streets. Thus, greater occurrences of hard-braking may correlate to lower safety values (e.g., and a greater probability of accidents), and vice-versa.

Finally, the traffic report generator 120 may compare the safety levels of the selected streets during the first period of time with the safety levels of the selected streets during the second period of time (430). In some examples, the traffic report may include a graphical comparison of the safety levels of the selected streets during the first period of time with the safety levels of the selected streets during the second period of time. In other examples, the traffic report may include a map display highlighting a degree of change or variance in the safety levels of the selected streets between the first period and the second period. Still further, the map display may differentiate streets that experienced an overall increase in safety levels from streets that experienced an overall decrease in safety levels.

User Interface Examples

FIGS. 5 and 6A-6E illustrate example user interfaces that may be provided to a computing device for purposes of creating and/or displaying traffic reports. With reference, for example, to the system 100 of FIG. 1, the user interfaces 500 and 610-650, respectively, illustrate user interfaces that can be provided by an application running on a client device 160. The application can enable data to be exchanged between the client device 160 and the system 100 so that a user of the client device 160 can view traffic reports provided by the system 100. More specifically, user interface 500 may be used to receive user input data 161 and user interfaces 610-650 may be used to display content from a corresponding traffic report 163 generated based on the user input data 161.

Figure 5:
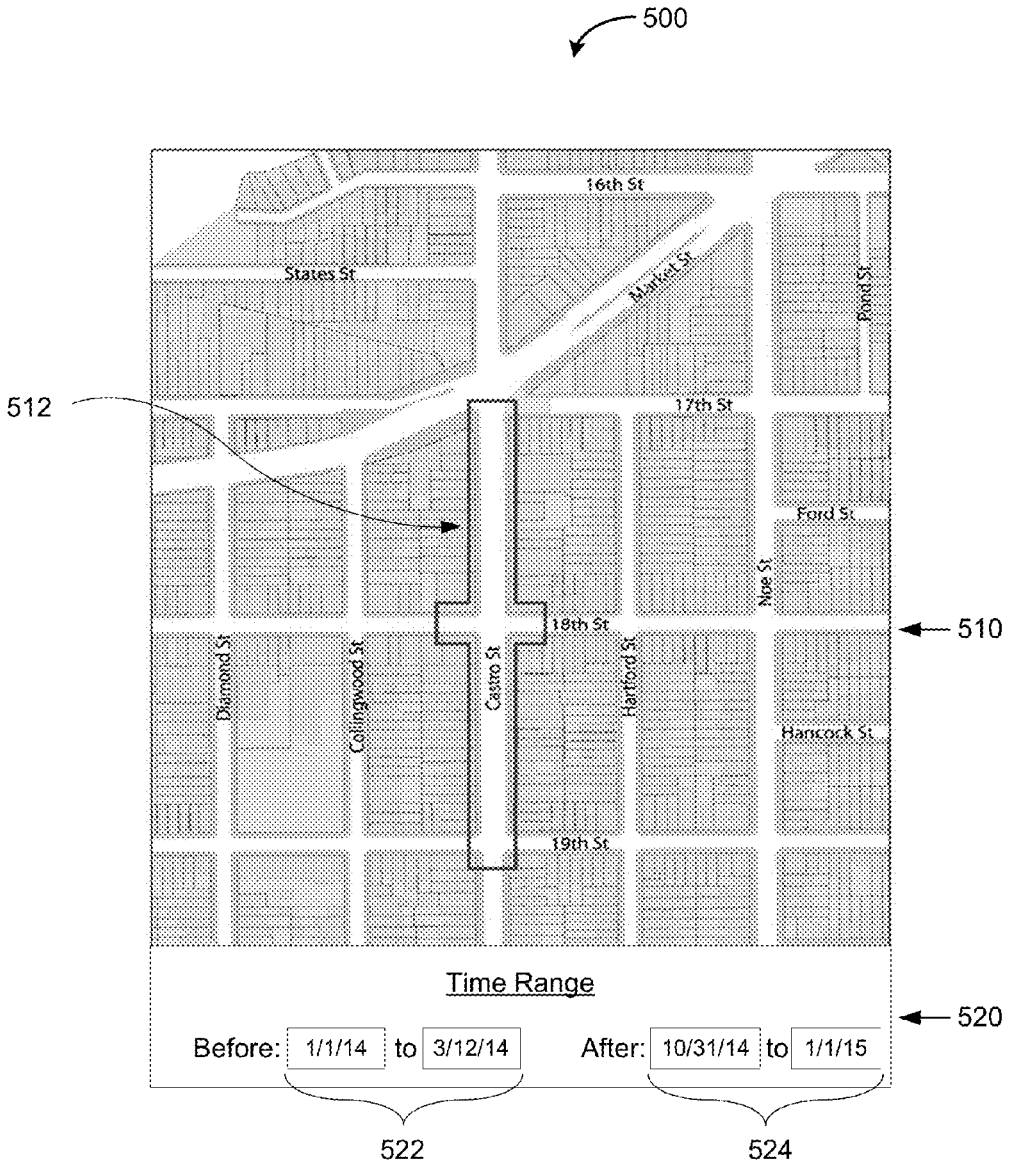
FIG. 5 illustrates an example user interface which may receive user inputs for generating traffic reports.

FIG. 5 illustrates an example user interface 500 which may receive user inputs for generating traffic reports. The user interface 500 includes a geographical input feature 510 and a time input feature 520. The geographical input feature 510 includes an interactive map display on which a user may select a geographical region for which to generate a traffic report. The geographical region may correspond to an area of a city that was affected by construction and/or other changes. For example, the user may click (or tap) on an area of the map to select a particular street, block, or neighborhood (e.g., associated with that region) as the geographical region. Alternatively, or in addition, the user may click-and-drag (or tap-and-drag) a cursor or pointer across a desired region of the map to select one or more streets, blocks, or neighborhoods at least partially located within or bounded by the desired region. In the example of FIG. 5, the selected geographical region 512 includes a segment of Castro Street that is bounded by 17th Street to the north, and 19th Street to the south.

The time input feature 520 allows the user to specify at least two time ranges for generating the traffic report. For example, the time input features 520 includes inputs for a user to select a first time period 522 and a second time period 524. For example, the user may select the upper and lower time boundaries for each of the time ranges 522 and 524 from a pull-down menu (e.g., by clicking on the respective boxes to the left and right of the word "to"). Alternatively, or in addition, the user may manually enter the upper and lower time boundaries, for example, using a keyboard or other numerical/character input device. The first time period 522 may correspond to a range of time before the construction project and/or changes took place in the selected geographical region 512. The second time period 524 may correspond to a range of time after the construction project and/or changes took place in the selected geographical region 512. In the example of FIG. 5, a construction project took place on Castro Street from Mar. 13, 2014 to Oct. 30, 2014. Accordingly, the first time period 522 has a lower bound of Jan. 1, 2014 and an upper bound of Mar. 12, 2014, and the second time period 524 has a lower bound of Oct. 31, 2014 and an upper bound of Jan. 1, 2015.

The example of FIG. 5 has been described for illustration purposes only. Thus, the user inputs that may be provided in the example user interface 500 are not limited to those shown in FIG. 5. For example, in some aspects, a user may select multiple streets as the selected geographical region 512. Furthermore, in other aspects, the time periods 522 and 524 may not be limited to a range of dates. Rather, a user may specify any range of time (e.g., including hours, days, months, years, etc.) for each of the time periods 522 and 524.

FIGS. 6A-6E illustrate example user interfaces 610-650, respectively, for displaying content that may be provided with a traffic report. The content of the traffic report (e.g., as illustrated in user interfaces 610-650) may be based on the user input data from the example of FIG. 5. For example, the traffic report may highlight the effects on traffic of a construction project that took place on Castro Street (e.g., from Mar. 13, 2014 to Oct. 30, 2014). More specifically, the traffic project was to expand the width of the sidewalk along Castro Street, thereby reducing the overall width and/or number of lanes of the portion of the street used for vehicular traffic. The intended effect may be to increase pedestrian safety and/or decrease the speed of vehicular traffic on Castro Street.

Figure 6A:
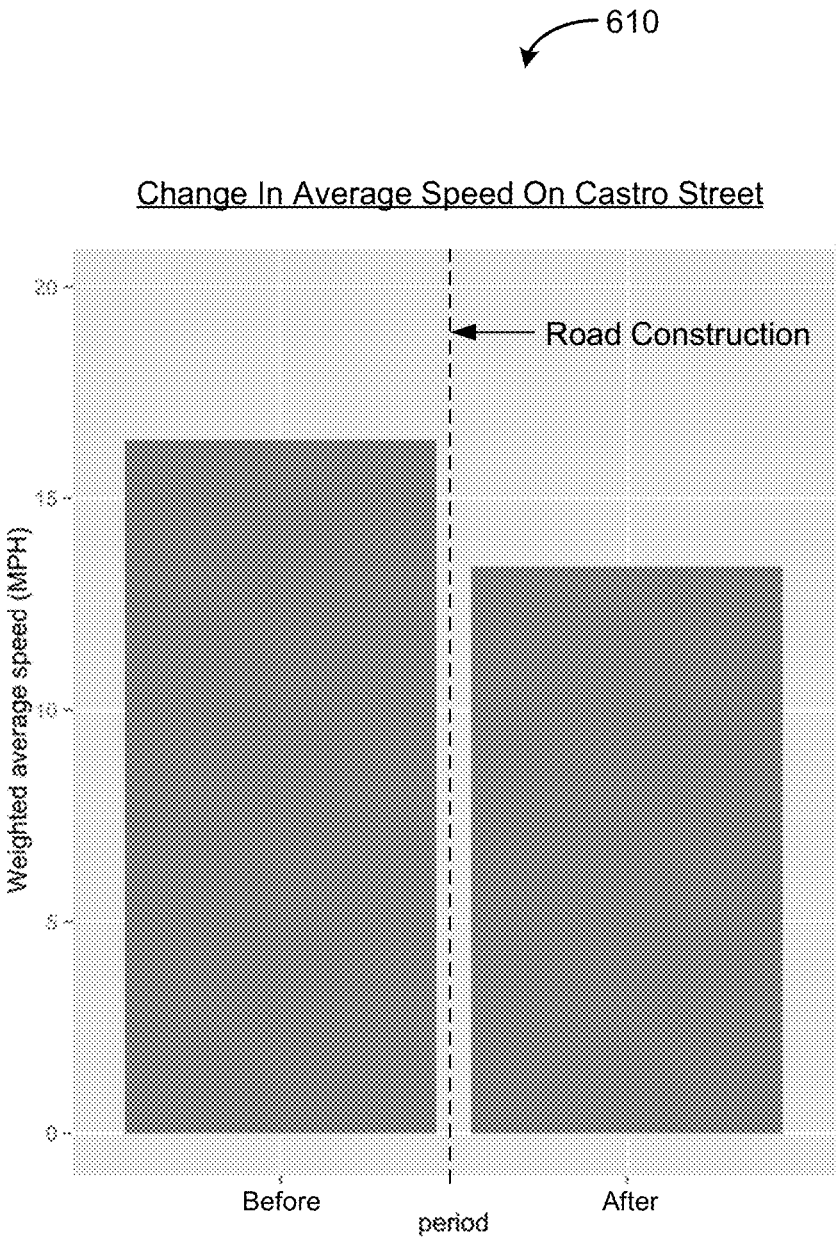
FIGS. 6A-6E illustrate example user interfaces for displaying content that may be provided with a traffic report.

FIG. 6A shows an example user interface 610 comparing the average speed of vehicular traffic in the selected geographical region before and after the construction took place. More specifically, the user interface 610 includes a bar graph showing the weighted average speed (e.g., in MPH) of vehicle traffic on Castro Street over time. A dotted line through the center of the bar graph indicates the period of time that road construction took place on Castro Street (e.g., from Mar. 3, 2014 to Oct. 30, 2014). The bar to the left of the dotted line shows the average speed of vehicle traffic (e.g., ~17 mph) on Castro Street during the specified time period before the construction took place (e.g., from Jan. 1, 2014 to Mar. 12, 2014). The bar to the right of the dotted line shows the average speed of vehicle traffic (e.g., ~13 mph) on Castro Street during the specified time period after the construction took place (e.g., from Oct. 31, 2014 to Jan. 1, 2015). Thus, it may appear from the example of FIG. 6A that the construction project achieved the desired effect of slowing down vehicle traffic (e.g., by ~4 mph) on Castro Street.

Figure 6B:
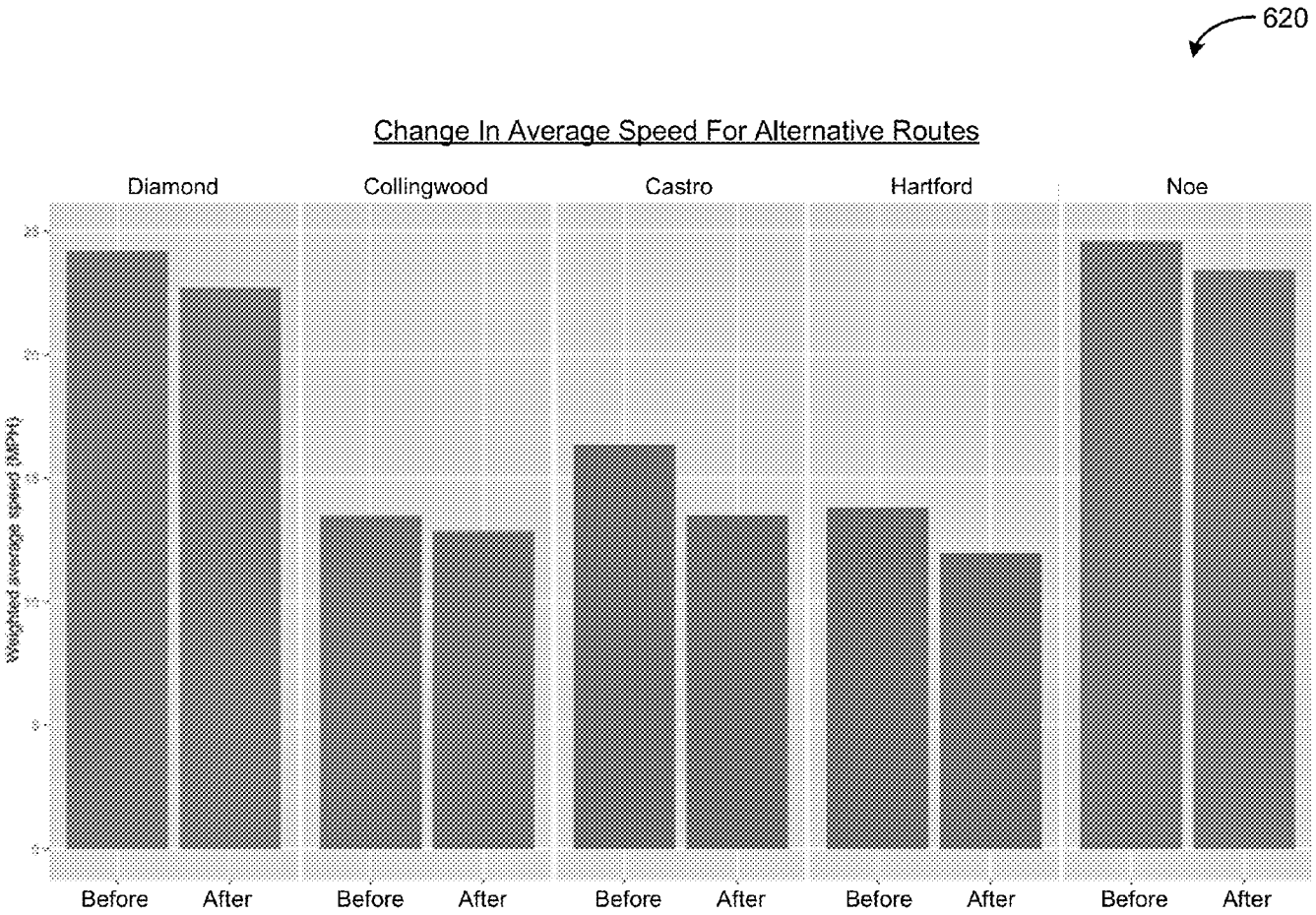

FIG. 6B shows an example user interface 620 comparing the average speeds of vehicular traffic in the neighborhood surrounding the selected geographical region, before and after the construction took place. More specifically, the user interface 620 includes a number of bar graphs showing the weighted average speed (e.g., in MPH) of vehicle traffic on Castro Street and neighboring streets (e.g., Diamond, Collingwood, Hartford, and Noe) that run parallel to Castro Street. As described above, the neighboring streets may serve as alternative routes (e.g., between 17th, 18th, and 19th Streets) that may be taken in lieu of Castro Street.

In the example shown with respect to FIG. 6B, there was an overall reduction in the average speeds on each of the neighboring streets (e.g., in addition to Castro Street) after the construction took place. For example, the average speed on Diamond was reduced by ~2 mph, the average speed on Collingwood was reduced by ~1 mph, the average speed on Hartford was reduced by ~2 mph, and the average speed on Noe was reduced by ~1 mph. Thus, it may appear from the example of FIG. 6B that the construction project caused an increase in vehicle traffic on the neighboring streets that run parallel to Castro Street (e.g., possibly as a result of people attempting to detour around Castro Street to avoid even greater delays).

Figure 6C:
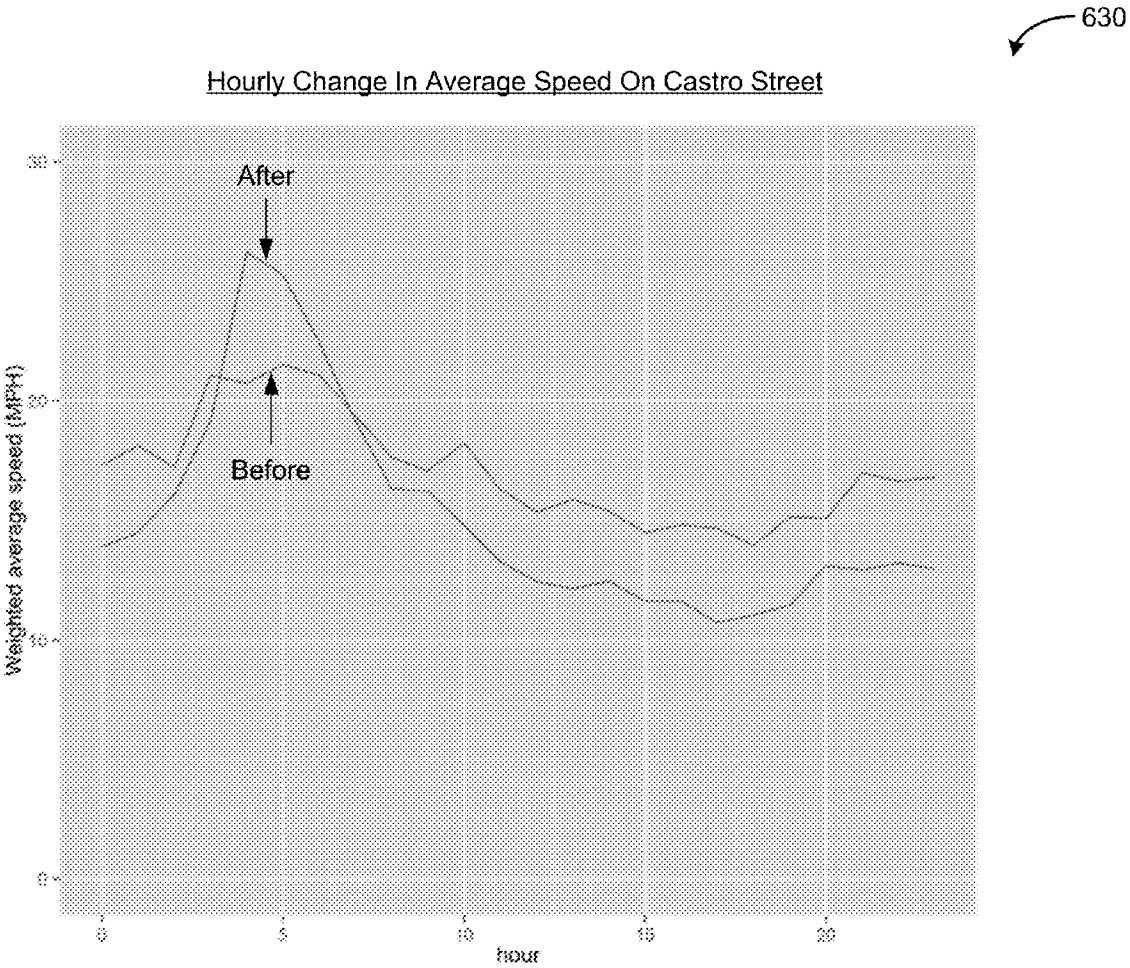

FIG. 6C shows an example user interface 630 comparing hourly changes in average speed of vehicular traffic in the selected geographical region, before and after the construction took place. More specifically, the user interface 630 includes a line chart showing the weighted average speed (e.g., in MPH) of vehicle traffic on Castro Street over time. Although the results show a spike a vehicle speeds (e.g., after the construction took place) between the hours of 3 AM to 6 AM, the general trend of the line chart supports the conclusion that the construction project caused an overall decrease in average vehicle speeds on Castro Street. The most significant reduction in vehicle speeds occurred between the hours of 10 AM and 10 PM (e.g., during which the greatest number of pedestrians are likely to be out on the street). Thus, it may appear from the example of FIG. 6C that the construction project achieved the desired effect of increasing pedestrian safety on Castro Street.

Figure 6D:
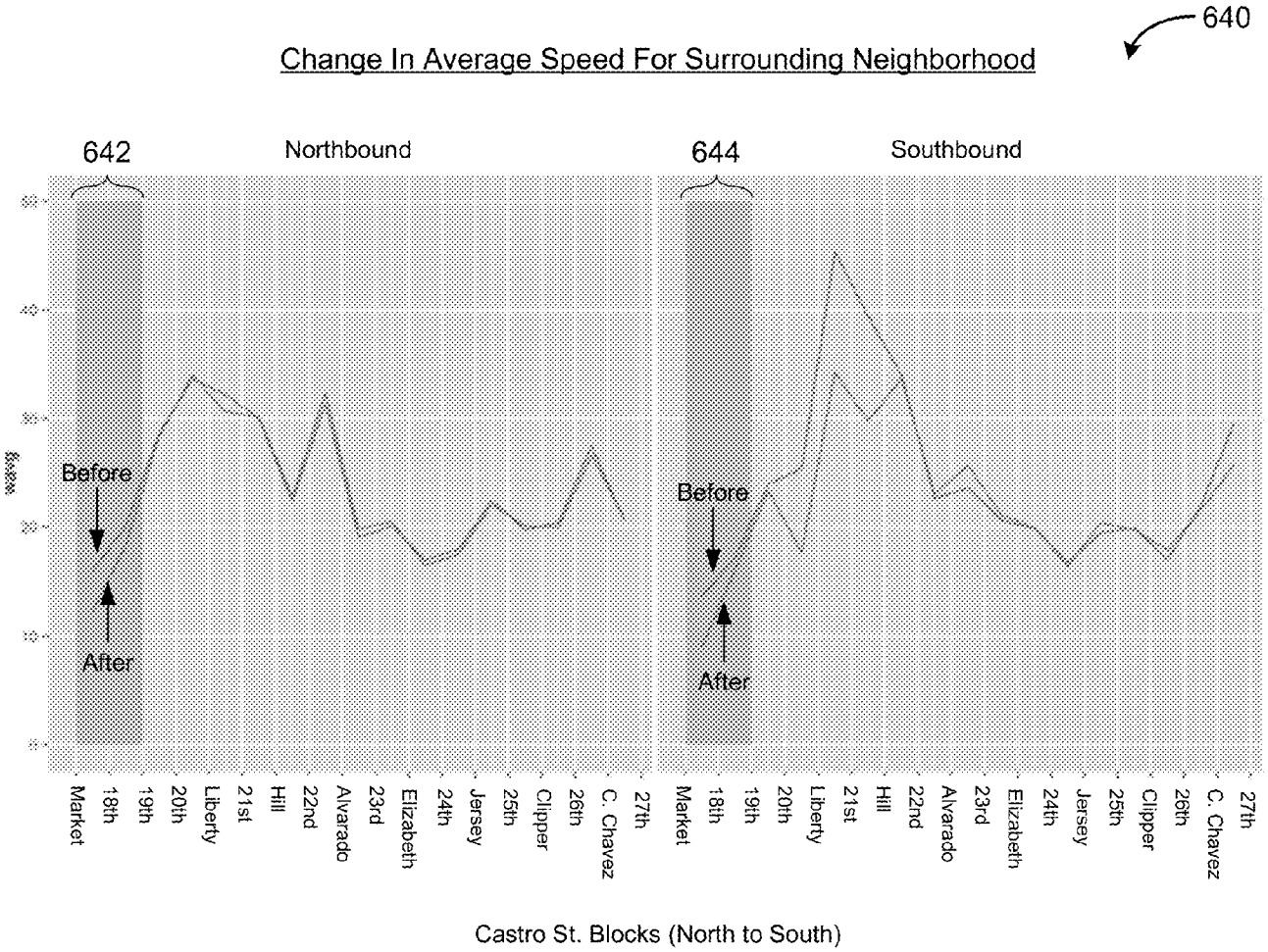

FIG. 6D shows an example user interface 640 comparing the average speeds of northbound and southbound vehicular traffic in the neighborhood surrounding the selected geographical region, before and after the construction took place. More specifically, the user interface 640 includes a number of line charts showing the weighted average speed (e.g., in MPH) of vehicle traffic on neighboring streets (e.g., Market, 18th, 19th, 20th, Liberty, 21st, Hill, 22nd, Alvarado, 23rd, Elizabeth, 24th, Jersey, 25th, Clipper, 26th, Cesar Chavez, and 27th) that intersect or otherwise run perpendicular to Castro Street.

The chart on the left shows the average northbound traffic on each of the neighboring streets before and after the construction took place. The chart on the right shows the average southbound traffic on each of the neighboring streets before and after the construction took place. Greyed out areas 642 and 644 on the left-hand side of the northbound and southbound charts, respectively, represent the geographical region 512 in which the construction took place. For example, Market Street, 18th Street, and 19th Street pass through the geographical region 512 directly affected by construction. Street names listed further from the greyed out areas 642 and 644 are in turn further away from the geographical region 512 directly affected by construction.

In the example shown with respect to FIG. 6D, the average speeds of northbound vehicle traffic remained relatively unchanged after the construction took place. On the other hand, there was a noticeable reduction in the average speeds of southbound vehicle traffic on the same streets. The most significant reductions in the speeds of southbound traffic occurred between Market and Hill street (e.g., those closest to the geographical region 512), whereas streets south of 22nd Street experienced little or no change in average speed. Thus, it may appear from the example of FIG. 6D that the construction project caused an increase in vehicle traffic on some of the neighboring streets that intersect or otherwise run perpendicular to Castro Street (e.g., possibly as a result of people attempting to detour around Castro Street to avoid even greater delays).

Figure 6E:
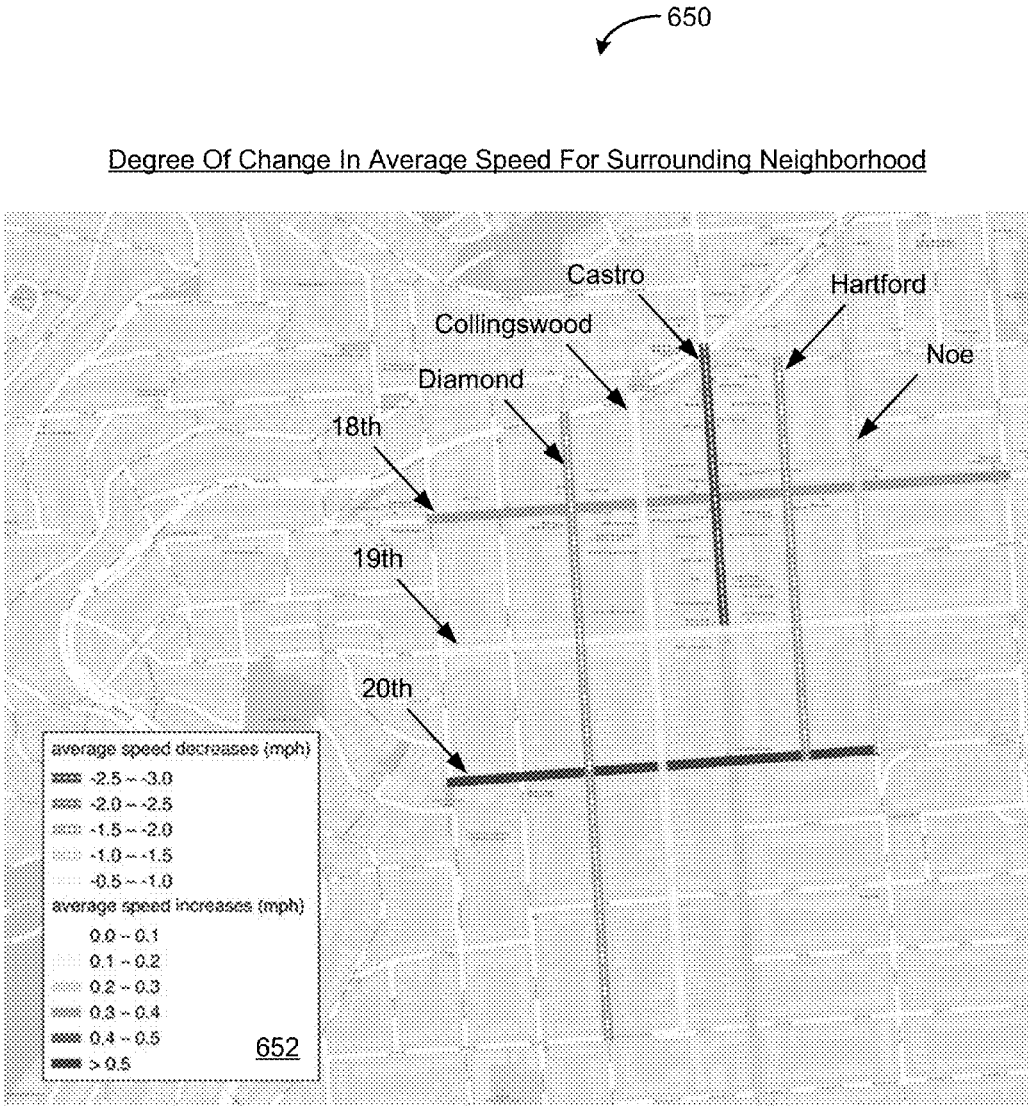

FIG. 6E shows an example user interface 650 highlighting the degrees of change in average speeds of vehicular traffic in the neighborhood surrounding the selected geographical region as a result of the construction project. More specifically, the user interface 650 includes a map of the neighborhood surrounding the geographical region 512 (e.g., Castro Street). Each street may be highlighted (e.g., shaded or colored) in a particular way to reflect the degree of change in average speed from before to after the construction took place. For example, with reference to the key 652, each statistically-significant change in speed may by highlighted by a different color, shade, and/or pattern. In the example of FIG. 6E, speed increases on the order of 0.1 mph may be deemed statistically significant, whereas speed decreases on the order of 0.5 mph may be deemed statistically significant. This reflects the user's goal of reducing, rather than increasing, average speeds in the neighborhood (e.g., to increase the safety of pedestrians).

In the example shown with respect to FIG. 6E, the segment of Castro Street bounded by 17th and 19th experienced the greatest overall reduction in average speed (e.g., 2.5-3 mph reduction), whereas the remaining portion of Castro Street (e.g., south of 19th Street) experienced an overall increase in average speed (e.g., 0.2 0.3 mph increase). On the other hand, the average speeds on Collingsworth and 19th Street remained relatively unchanged as a result of the construction. Diamond and Hartford Streets both experienced moderate speed decreases (e.g., 1.5-2 mph decrease), while Noe Street experienced a more subtle speed decrease (e.g., 1-1.5 mph decrease). 20th Street experienced the greatest overall increase in average speed (e.g., >0.5 mph increase), followed by 18th Street (e.g., 0.3-0.4 mph increase).

Hardware Diagrams

Figure 7:
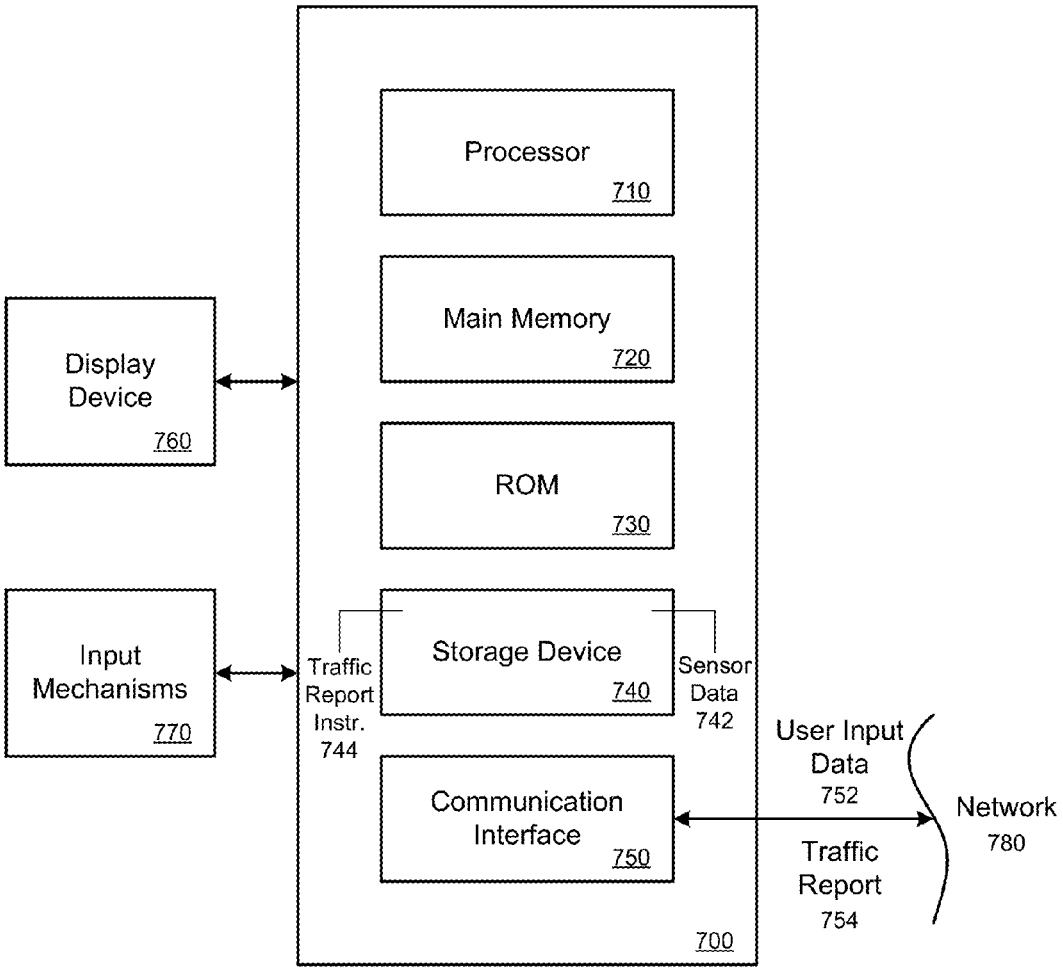
FIG. 7 is a block diagram that illustrates a computer system upon which examples described herein may be implemented.

FIG. 7 is a block diagram that illustrates a computer system 700 upon which examples described herein may be implemented. For example, in the context of FIG. 1, the system 100 may be implemented using a computer system such as described by FIG. 7. The system 100 may also be implemented using a combination of multiple computer systems as described by FIG. 7.

In one implementation, computer system 700 includes processing resource 710, main memory 720, read-only memory (ROM) 730, storage device 740, and communication interface 750. The processor 710 for processing information and/or instructions stored in main memory 720. The main memory 720 may be, for example, a random access memory (RAM) or other dynamic storage device for storing information and instructions to be executed by the processor 710. Main memory 720 also may be used for storing temporary variables or other intermediate information during execution of instructions by processor 710. The ROM 730 may be a static storage device for storing static information and instructions for processor 710

The storage device 740 may be a solid-state device, a magnetic disk, or optical disc for storing information and instructions. For example, the storage device 740 may store sensor data 742 received from one or more provider devices in communication with the computer system 700. Furthermore, the storage device 740 may correspond to a computer-readable medium that stores traffic reporting instructions 744 for performing operations discussed with respect to FIGS. 1-4. Accordingly, the processor 710 may generate customized traffic reports 754 based on user input data 752 received from a client device over a wireless network 780, such as described with respect to FIGS. 1-4.

The communication interface 750 can enable the computer system 700 to communicate with one or more wireless networks 780 (e.g., cellular network, wireless local area network, etc.) through use of the network link (e.g., wireless or wireline). Using the network link, the computer system 700 can communicate with one or more computing devices and/or one or more servers. According to some examples, the computer system 700 can receive provider updates from one or more computing devices (e.g., belonging to service providers) via the network link. Sensor data 742 can be acquired from the provider updates by the processor 710 and can be stored in, for example, the storage device 740. The processor 710 can further process the sensor data 742 in order to generate a traffic report 754 based at least in part on one or more parameters (e.g., geographical region, first period of time, and second period of time) included with user input data 752 received, via the network 780, from a client device. The traffic report 754 can be transmitted back to the client device via the network 780.

Computer system 700 can also include a display device 760, such as a cathode ray tube (CRT), an LCD monitor, or a television set, for example, for displaying graphics and information to a user. An input mechanism 770, such as a keyboard that includes alphanumeric keys and other keys, can be coupled to computer system 700 for communicating information and command selections to processor 710. Other non-limiting, illustrative examples of input mechanisms 770 include a mouse, a trackball, touch-sensitive screen, or cursor direction keys for communicating direction information and command selections to processor 710 for controlling cursor movement on display 760.

Examples described herein are related to the use of the computer system 700 for implementing the techniques described herein. According to one example, those techniques are performed by the computer system 700 in response to the processor 710 executing one or more sequences of one or more instructions contained in the main memory 720, such as the traffic reporting instructions 744. Such instructions may be read into the main memory 720 from another machine-readable medium, such as the storage device 740. Execution of the sequences of instructions contained in the main memory 720 causes the processor 710 to perform the process steps described herein. In alternative implementations, hard-wired circuitry may be used in place of or in combination with software instructions to implement examples described herein. Thus, the examples described are not limited to any specific combination of hardware circuitry and/or software.

It is contemplated for examples described herein to extend to individual elements and concepts described herein, independently of other concepts, ideas or system, as well as for examples to include combinations of elements recited anywhere in this application. Although examples are described in detail herein with reference to the accompanying drawings, it is to be understood that the concepts are not limited to those precise examples. Accordingly, it is intended that the scope of the concepts be defined by the following claims and their equivalents. Furthermore, it is contemplated that a particular feature described either individually or as part of an example can be combined with other individually described features, or parts of other examples, even if the other features and examples make no mentioned of the particular feature. Thus, the absence of describing combinations should not preclude having rights to such combinations.

What is claimed is:

1. A method of operating a network service to generate traffic reports, the method being implemented by one or more processors and comprising:

establishing, over one or more networks, wireless communications with a plurality of mobile computing devices, each of the plurality of mobile computing devices being carried within a corresponding vehicle that operates in a given geographic region, wherein establishing wireless communications includes:

causing a service application to operate on each of the plurality of mobile computing devices to (i) interface with multiple sensors of the mobile computing device in order to determine sensor information, the sensor information including position information that identifies a position of the mobile computing device at a corresponding instance of time, and acceleration information detected from one or more sensors of the mobile computing device at the corresponding instance of time, and (ii) automatically and repeatedly transmit the sensor information to the network service;

filtering the sensor information transmitted from the plurality of mobile devices, based on the position of each of the plurality of mobile computing devices, to identify each of (i) a first aggregation of sensor information that includes acceleration information determined from the one or more sensors of a first set of multiple computing devices of the plurality of computing devices, when the corresponding instance of time is within a first period of time, and (ii) a second aggregation of sensor information that includes acceleration information determined from the one or more sensors of a second set of multiple computing devices of the plurality of computing devices, when the corresponding instance of time is within a second period of time; and generating a traffic report that indicates a safety level of one or more streets based at least in part on a comparison of the first aggregation of sensor information for the first period of time and the second aggregation of sensor information for the second period of time.

2. The method of claim 1, wherein the sensor information includes sensor data received from one or more vehicles associated with a transport service.

3. The method of claim 1, wherein the sensor information includes an average speed of the one or more vehicles while driving on the one or more streets.

4. The method of claim 3, wherein the traffic report includes a graphical display comparing the average speed on each of the one or more streets during the first period of time with the average speed on each of the one or more streets during the second period of time.

5. The method of claim 3, wherein the traffic report includes a map display of the geographical region highlighting, for each of the one or more streets, a degree of change in the average speed from the first period of time to the second period of time.

6. The method of claim 5, wherein the map display further indicates, for each of the one or more streets, whether the average speed increased or decreased from the first period of time to the second period of time.

7. The method of claim 1, wherein the sensor information further includes deceleration information detected from one or more sensors of the mobile computing device at the corresponding instance of time for the one or more vehicles while driving on the one or more streets.

8. The method of claim 7, further comprising:

determining the safety level for each of the one or more streets based at least in part on at least one of the acceleration and the deceleration information.

9. The method of claim 8, wherein the traffic report indicates, for each of the one or more streets, whether the safety level increased or decreased from the first period of time to the second period of time.

10. The method of claim 1, wherein identifying the one or more streets comprises:

identifying a first subset of the one or more streets, wherein each street in the first subset is located within the geographical region;

determining a set of alternate routes for the first subset of streets; and identifying a second subset of the one or more streets, wherein each street in the second subset belongs to the set of alternate routes.

11. A non-transitory computer-readable medium storing instructions that, when executed by one or more processors of a network service system for generating traffic reports, cause the system to perform operations comprising:

establishing, over one or more networks, wireless communications with a plurality of mobile computing devices, each of the plurality of mobile computing devices being carried within a corresponding vehicle that operates in a given geographic region, wherein establishing wireless communications includes:

causing a service application to operate on each of the plurality of mobile computing devices to (i) interface with multiple sensors of the mobile computing device in order to determine sensor information, the sensor information including position information that identifies a position of the mobile computing device at a corresponding instance of time, and acceleration information detected from one or more sensors of the mobile computing device at the corresponding instance of time, and (ii) automatically and repeatedly transmit the sensor information to the network service;

filtering the sensor information transmitted from the plurality of mobile devices, based on the position of each of the plurality of mobile computing devices, to identify each of (i) a first aggregation of sensor information that includes acceleration information determined from the one or more sensors of a first set of multiple computing devices of the plurality of computing devices, when the corresponding instance of time is within a first period of time, and (ii) a second aggregation of sensor information that includes acceleration information determined from the one or more sensors of a second set of multiple computing devices of the plurality of computing devices, when the corresponding instance of time is within a second period of time; and generating a traffic report that indicates a safety level of one or more streets based at least in part on a comparison of the first aggregation of sensor information for the first period of time and the second aggregation of sensor information for the second period of time.

12. The non-transitory computer-readable medium of claim 11, wherein the sensor information includes sensor data received from one or more vehicles associated with a transport service.

13. The non-transitory computer-readable medium of claim 11, wherein the sensor information includes an average speed of the one or more vehicles while driving on the one or more streets.

14. The non-transitory computer-readable medium of claim 13, wherein the traffic report includes a graphical display comparing the average speed on each of the one or more streets during the first period of time with the average speed on each of the one or more streets during the second period of time.

15. The non-transitory computer-readable medium of claim 13, wherein the traffic report includes a map display of the geographical region highlighting, for each of the one or more streets, a degree of change in the average speed from the first period of time to the second period of time.

16. The non-transitory computer-readable medium of claim 15, wherein the map display further indicates, for at least the highlighted streets, whether the average speed increased or decreased form the first period of time to the second period of time.

17. The non-transitory computer-readable medium of claim 11, wherein the sensor information further includes deceleration information detected from one or more sensors of the mobile computing device at the corresponding instance of time for the one or more vehicles while driving on the one or more streets.

18. The non-transitory computer-readable medium of claim 17, wherein execution of the instructions by the one or more processors further causes the system to perform operations comprising:

determining the safety level for each of the one or more streets based at least in part on at least one of the acceleration and the deceleration information, and wherein the traffic report indicates, for each of the one or more streets, whether the safety level increased or decreased from the first period of time to the second period of time.

19. The non-transitory computer-readable medium of claim 11, wherein execution of the instructions to identify the one or more streets causes the system to perform operations comprising:

identifying a first subset of the one or more streets, wherein each street in the first subset is located within the geographical region;

determining a set of alternate routes for the first subset of streets; and identifying a second subset of the one or more streets, wherein each street in the second subset belongs to the set of alternate routes.

20. A network service system for generating traffic reports, the system comprising:

a memory that stores instructions; and one or more processors that execute the instructions stored in the memory to:

establish, over one or more networks, wireless communications with a plurality of mobile computing devices, each of the plurality of mobile computing devices being carried within a corresponding vehicle that operates in a given geographic region, wherein establishing wireless communications includes:

causing a service application to operate on each of the plurality of mobile computing devices to (i) interface with multiple sensors of the mobile computing device in order to determine sensor information, the sensor information including position information that identifies a position of the mobile computing device at a corresponding instance of time, and acceleration information detected from one or more sensors of the mobile computing device at the corresponding instance of time, and (ii) automatically and repeatedly transmit the sensor information to the network service;

filter the sensor information transmitted from the plurality of mobile devices, based on the position of each of the plurality of mobile computing devices, to identify each of (i) a first aggregation of sensor information that includes acceleration information determined from the one or more sensors of a first set of multiple computing devices of the plurality of computing devices, when the corresponding instance of time is within a first period of time, and (ii) a second aggregation of sensor information that includes acceleration information determined from the one or more sensors of a second set of multiple computing devices of the plurality of computing devices, when the corresponding instance of time is within a second period of time;

and generate a traffic report that indicates a safety level of one or more streets based at least in part on a comparison of the first aggregation of sensor information for the first period of time and the second aggregation of sensor information for the second period of time.

* * * * *